US005320248A

United States Patent [19]

Jamieson, III

[11] Patent Number: 5,320,248

[45] Date of Patent: Jun. 14, 1994

[54] MIXING BUCKET AND INTEGRAL MOLD

[76] Inventor: Hugh V. Jamieson, III, 27851 Red River Dr., Lathrup Village, Mich. 48076

[21] Appl. No.: 24,478

[22] Filed: Mar. 1, 1993

[51] Int. Cl.[5] ..... B01F 9/10

[52] U.S. Cl. ..... 220/669; 206/119; 366/57; 366/228; 366/229

[58] Field of Search ..... 299/117; 366/225, 228, 366/229, 57; 206/119; 220/568, 669, 675, 731, 608

[56] References Cited

U.S. PATENT DOCUMENTS

| | | | |
|---|---|---|---|
| 209,870 | 1/1968 | Yates, Jr. . | |
| 1,165,905 | 12/1915 | Reimann . | |
| 2,061,610 | 11/1936 | Burnette | 220/608 |
| 2,504,378 | 4/1950 | Bell | 366/228 |
| 3,224,742 | 12/1965 | Hiser . | |
| 4,172,365 | 10/1979 | McClintock . | |
| 4,253,772 | 3/1981 | Burton-Smith | 366/130 |
| 4,255,058 | 3/1981 | Peleschka et al. | 366/228 |
| 4,332,482 | 6/1982 | Engler | 366/605 |
| 4,875,781 | 10/1989 | Raska | 366/228 |
| 4,880,312 | 11/1989 | Carlson . | |
| 4,950,082 | 8/1990 | Carlson | 366/229 |
| 4,973,167 | 11/1990 | Zmarlicki | 366/228 |

OTHER PUBLICATIONS

Scepter Mixing System Advertisement (p. 91–Home Improvement Center Aug.–1992).

*Primary Examiner*—Allan N. Shoap
*Assistant Examiner*—S. Castellano
*Attorney, Agent, or Firm*—Reising, Ethington, Barnard, Perry & Milton

[57] ABSTRACT

The mixing bucket and integral mold (10) has frustoconical walls (12), a bottom wall (14), a bottom rim (32) and top rim (24). A lid (16) closes and seals the bucket. A bail (28) is provided for lifting and carrying the bucket. A flange (38) that is integral with the bottom wall (14) and inside the bottom rim (32) reinforces and supports the bottom wall and forms a mold cavity (36). Agitators (60) each of which has a base, an integral post (68) and agitation surfaces (72) are attached to the inside surface of the frustoconical walls (12) along two helixes (62,64). The agitation surfaces are shaped and oriented to agitate and mix material when the bucket is rolled on its side walls (12). The agitation surfaces can be shaped and oriented to merely divide the material being mixed, to move material toward the lid (16), to move material toward the bottom wall (14), to move material radially inward toward the central axis (18) or to move material radially outward toward the side walls (12). The agitators (60) are axially spaced along the helixes (62,64) to reduce the torque required to rotate the bucket on its side walls (12). The lid (16) forms a cup that can be employed to measure material to be mixed.

16 Claims, 3 Drawing Sheets

MIXING BUCKET AND INTEGRAL MOLD

TECHNICAL FIELD

The invention relates to a bucket with agitators attached to its walls that mix liquids and granular solids such as water, aggregate and cement when the bucket is rolled on its side. A lid with a cavity for measuring the volume of the materials to be mixed in a cavity in the bottom of the bucket which can be employed to mold materials that are mixed in the bucket following mixing.

BACKGROUND OF THE INVENTION

Containers that roll on the ground or other surfaces to mix concrete have been known for many years. These containers have been special purpose containers that have no function other than mixing materials. The internal baffles in these containers which agitate the material being mixed have been positioned on the walls of the containers in positions which substantially increase the force required to roll the containers. This makes these containers hard to roll manually by hand or by pushing them with your foot.

Buckets which are oscillated back and forth about a vertical axis while being supported by hand are also well-known. These buckets can be used to mix materials such as paint but do not provide sufficient agitation to mix water, aggregate and cement or other similar materials.

SUMMARY OF THE INVENTION

An object of the invention is to provide a bucket with a plurality of agitators attached to its inside walls that can be rolled on the ground or other surfaces to mix material such as water, aggregate and cement. Another object of the invention is to provide a bucket with a plurality of agitators that are attached to the inside walls of the bucket in a pattern which allow the bucket to be rolled along the ground or other surfaces by a relatively constant force to mix materials in the bucket. A further object of the invention is to provide a bucket and agitators which can be attached to the inside walls of the bucket to provide efficient mixing of specific materials to be mixed by rolling the bucket on its side.

The bucket and integral mold is a round plastic material container with a flat inside bottom, tapered walls and a top rim. A lid with a groove that receives the top rim and locks in place closes the open top. The groove in the lid receives a seal that seals between the lid and the top rim of the bucket to create a liquid tight seal and prevent leakage from the bucket. The lid provides a flat inside wall that telescopes axially into the bucket when the lid is closed. The outside of the lid has a flat central surface encircled by a rim. The raised rim has an internal groove that opens towards the bucket and receives the rim of the bucket when the lid closes the bucket. The central surface of the lid and the raised rim form a cup-shaped container that can be used to measure materials that are placed in the bucket to be mixed. The bottom of the bucket has an outer rim that extends down from the bottom wall, protects the bottom wall of the bucket and supports the bucket when it is supported in an upright position on its bottom. The outer rim of the bucket extends downwardly from the bucket bottom wall a sufficient distance to provide a mold cavity for molding concrete objects in the outside bottom portion of the bucket. Additional flanges are attached to the outside surface of the bucket bottom and inside the outer rim of the bucket bottom to form a mold cavity of a desired shape. The additional flanges provide support for the bottom of the bucket and reinforce the bucket bottom.

A bail is pivotally attached to the walls of the bucket near the top rim. The bail provides a handle for carrying the bucket. The bail can be removed if necessary when rolling the bucket on its side to mix material inside the bucket. Removing the bail prevents interference with bucket rolling when the bucket is rolled on its side.

A plurality of agitators are attached to the inside walls of the bucket to agitate and mix material inside the bucket when the bucket is rolled on its side. The agitators are attached to the inside walls of the bucket along two separate helixes that extend from the bottom of the bucket to the top of the bucket and that are 180 degrees from each other in any plane perpendicular to the bucket central axis. The agitators are spaced apart along each helix so that there are a few agitators in contact with material being mixed at all times and the resistance to rolling caused by the agitators is minimized.

Each agitator has a base and a post. The base is curved to fix the conical surface of the bucket walls. The base can be attached to the bucket walls by adhesives, by sonic welding or by other suitable attaching procedures. The post is integral with the base and extends radially inward toward the central axis of the bucket. The post and leading surface that tend to move the material being mixed toward the bottom of the bucket, toward the bucket lid or merely pass through the material being mixed with equal axial movement in both directions. A variety of agitators can be used and placed in patterns so that they tend to move material being mixed axially toward the center of the bucket and away from both the bucket bottom and bucket lid. A variety of agitators can also be placed in patterns that tend to move material being mixed axially away from the center of the bucket and toward both the bucket bottom and the bucket lid. Another effective arrangement is to have the agitators along one helix move material being mixed toward the bucket bottom and the agitators along the other helix move material being mixed toward the bucket lid. The agitators are spaced apart and extend from a position adjacent to the bucket bottom to a position adjacent to the bucket lid when the lid is on the bucket. Agitators adjacent to the bucket bottom and adjacent to the lid help prevent materials from sticking where the bucket walls join the bucket lid and the bucket bottom.

The surface of the post portion of the agitators which contacts and displaces material being mixed in the bucket can extend radially toward the bucket central axis. The post surface which contacts the material being mixed can also extend inwardly and away from the direction of rotation so that during operation the agitators tend to move the material away from the bucket walls. The posts of agitators can also extend radially inward and toward the direction of rotation so that during operation the agitators tend to displace material being mixed outward toward the bucket walls.

The surfaces of the post of the agitators that contact and agitate material being mixed can be in generally flat planes as described above, can be concave or can be convex. A concave surface would tend to displace material axially toward the center of the agitator post and then move it radially along the concave groove. A convex surface tends to move material being mixed axially to both sides of an agitator post.

The foregoing and other objects, features and advantages of the present invention will become apparent in light of the following detailed description of exemplary embodiments thereof as illustrated in the accompanying drawings.

DETAILED DESCRIPTION OF THE PREFERRED EMBODIMENTS

Figure 1:
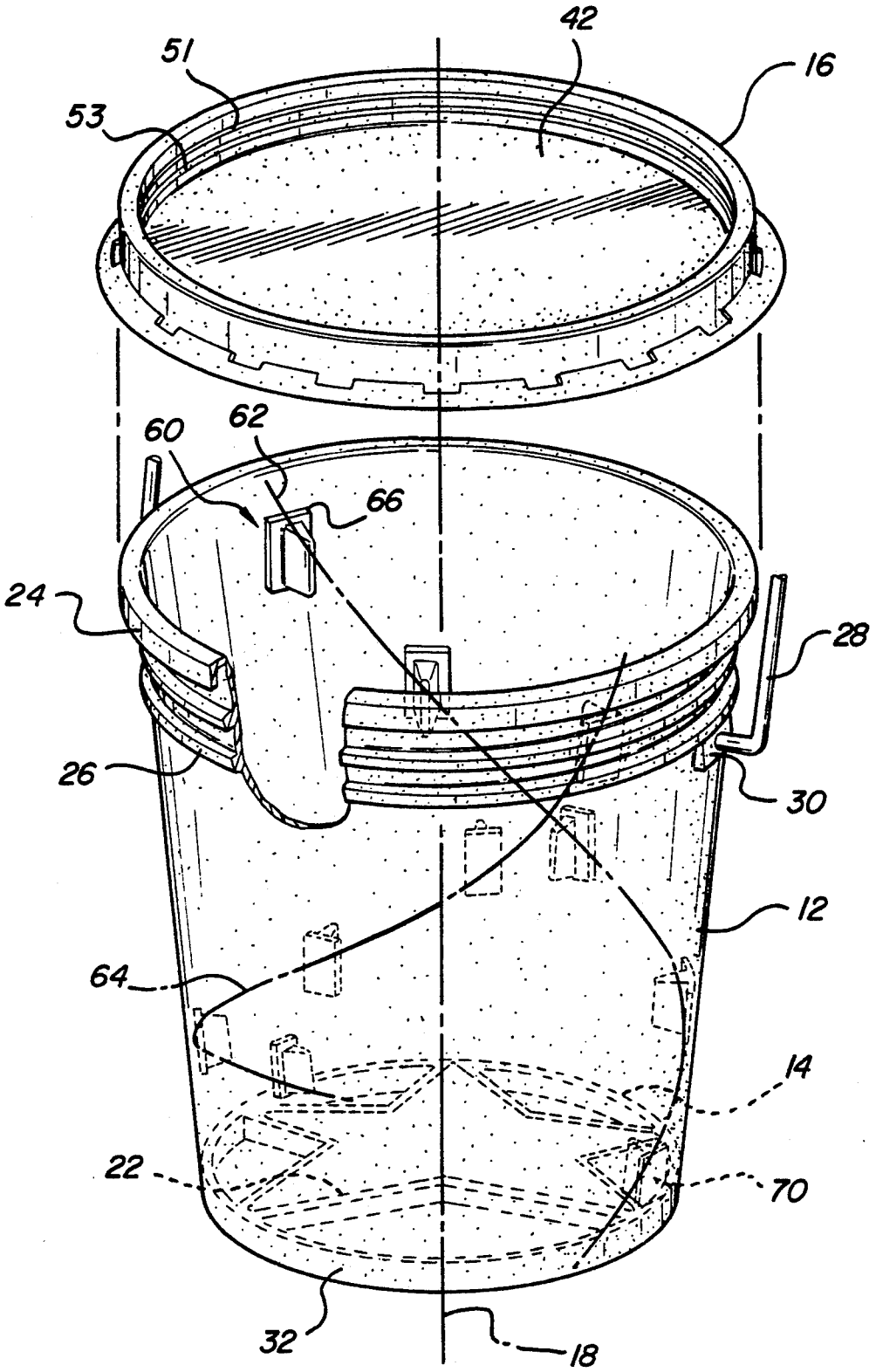
FIG. 1 is a perspective view of a mixing bucket With parts broken away and with the lid separated from the open top.

The mixing bucket and integral mold 10 has walls 12, a bottom wall 14 and a lid 16. The walls 12 are preferably the shape of a truncated cone and have a central axis 18. The walls 12 are circular in any plane that is perpendicular to the central axis 18. The bottom wall 14 is in the small diameter end of the mixing bucket and integral mold 10. The inside surface 22 of the bottom wall 20 is generally flat and is in a plane that is perpendicular to the central axis 18. A top rim 24 is integral with the walls 12 and defines the open top of the mixing bucket and integral mold 10. Reinforcing ribs 26 are provided on the outside of the walls 12 adjacent to the top rim 24. The reinforcing rims are circular ribs in planes that are perpendicular to the central axis 18.

A bail 28 with its ends each secured in a boss 30 on the upper outer surface of the walls 12 functions as handle for carrying the mixing bucket and integral mold 10. The ends of the bail 28 can be disengaged from the bosses 30 to remove the bail. It is desirable to be able to remove the bail so that it does not interfere with rolling the mixing bucket and integral mold 10 on the walls 12 to mix material inside the bucket.

Figure 2:
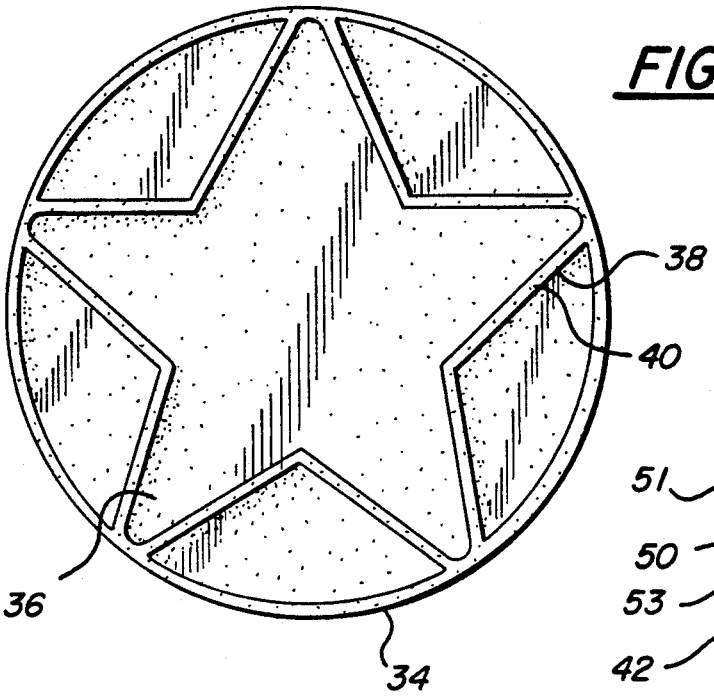
FIG. 2 is a bottom view of the bucket bottom and the mold cavity.

A bottom rim 32 is an extension of the walls 12 and extends downwardly from the bottom wall 14 of the mixing bucket and integral mold 10, bottom rim 32 has a bottom surface 34 which is in a plane perpendicular to the central axis 18. The bottom surface 34 contacts the ground, a floor or some other surface to support the mixing bucket and integral mold 10 when the mixing bucket is in an upright position. The bottom rim 32 extends past the bottom surface of the bottom wall 14, a sufficient distance to form a mold cavity 36 which is open to the outside of the mixing bucket and integral mold 10. The mold cavity 36 is used to form concrete into patio blocks, for example. If only the bottom rim 32 is employed blocks formed in the mold would be circular. To form blocks with a different shape it is necessary to provide flanges 38 that are integral with the bottom wall 14 and the bottom rim 32 and that form a mold cavity 36 with a desired shape. The mold cavity 36, as shown in FIGS. 1 and 2, is in the shape of a star. The bottom surface 40 of the flanges 38 is in a flat plane with the bottom surface 34 of the bottom rim 32. This allows the use of a member with a straight edge to strike excess concrete from the top of the mold cavity 36. The flanges 38 cooperate with the bottom rim 32 to support and reinforce the bottom wall 14 of the mixing bucket and integral mold 10. Without the flanges 38 the bottom wall 14 tends to bow and deform when there is material the mixing bucket and integral mold 10.

The top of the mixing bucket and integral mold 10 can be closed by a removable lid 16. The lid 16 has a flat circular wall section 42 surrounded by an integral upstanding rim 44. The rim 44 includes a circular groove 46 that opens to the bottom and receives the top rim 24 when the mixing bucket and integral mold 10 is closed by the lid 16. A flexible seal 48 in the circular groove 46 seals between the lid 16 and the top rim 24 to prevent leakage. The inner wall 50 of the rim 44 telescopes down inside the top rim 24 of the open top of the mixing bucket and integral mold 10. An outer wall 52 of the rim 44 on the lid 16 has a series of integral retainer blocks 54 which project radially inward toward the inner wall 50. The integral retaining blocks 54 engage the bottom of the top rim 24 to retain the lid 16 in sealing contact with the top rim. The lid 16 is removed from the top rim 24 of the mixing bucket and integral mold 10 by lifting up and out from the central axis 18 on the segmented skirt sections 56 of the outer wall 52 of the rim 44. When sufficient force is applied, the segmented skirt sections 56 and the outer wall 52 of the rim 44 on the lid 16 are deflected and distorted sufficiently to move the integral retainer blocks 54 out from under the top rim 24 and for the lid 16 to be moved up off the top rim 24 to open the mixing bucket and integral mold 10.

Figure 3:
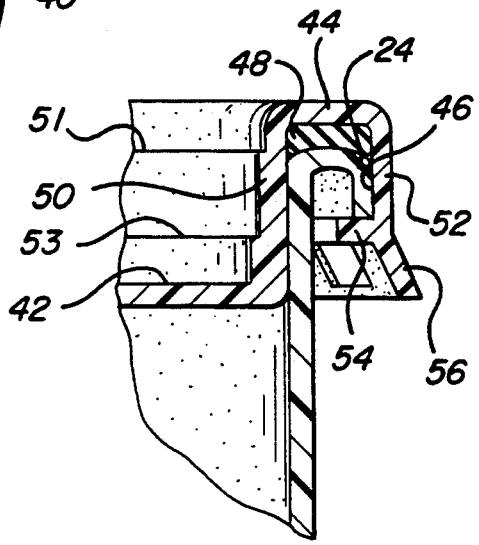
FIG. 3 is an enlarged sectional view showing the seal between the lid and the top rim of the bucket.

The rim 44 and the flat circular wall section 42 of the lid 16 form a cup. The cup portion of the lid 16 can be used to measure materials that are to be mixed before the materials are deposited in the mixing bucket and integral mold 10 for mixing. The inner wall 50 of the rim 44 forms the walls of the cup portion of the lid 16 for measuring materials and also telescopes into the top rim 24 of the mixing bucket and integral mold 10 to center the lid in the top rim 24 to hold the flexible seal 48 in place and to improve sealing. The inner wall 50, as shown in FIGS. 1 and 3 has two steps 51 and 53. These steps are positioned to clearly indicate the quantities of materials that are required. The positions of the steps 51 and 53 are set at the time of manufacture to provide the correct measurements. In the event that more than three materials are to be mixed, additional steps in the inner wall 50 can be provided. It is also possible to provide multiples of some components. The cup portion of the lid 16 might, for example, be completely filled with aggregate twice, filled with cement up to step 53 once and then filled with water up to step 51 once. The measured materials would be placed inside the mixing bucket and integral mold 10 for mixing following measurement. The steps 51 and 53 result in increased thickness of the inner wall 50 where it joins the flat circular wall section 42. This increased thickness of the inner wall 50 reduces distortion of the top rim 24 when the mixing bucket and integral mold is rolled on its side to mix material. The reduced distortion ensures that the flexible seal 48 remains in sealing contact with the top rim 24 and the lid 16.

The mixing bucket and integral mold 10 has a capacity to hold about five U.S. gallons. A smaller container with a capacity of two gallons or a larger container with a capacity of ten gallons or more could be used if desired. When mixing material, the mixing bucket and integral mold would not be completely filled. Normally between ten percent and fifty percent of total capacity would be mixed at one time.

Agitators 60 are attached to the walls 12 to agitate and mix material when the mixing bucket and integral mold 10 is rotated about its central axis 18 by being rolled on the ground or some other surface. The agitators 60 are spaced along the helix 62 and the helix 64 so that an annular zone is provided between adjacent agitators along each helix. The pitch of the helix 62 is the same as the pitch of the helix 64 as shown in FIG. 1. The helix 62 starts at a point 180 degrees from the helix 64 adjacent to the bottom wall 14. Two agitators 60 in a common plane perpendicular to the central axis 18 are therefore spaced 180 degrees apart. As shown in FIG. 1, each helix 62 and 64 wraps 180 degrees around the central axis 18 as it extends in a spiral path from the bottom wall 14 to the lid 16. Spacing the agitators 60 in this way in a segmented spiral pattern provides adequate agitation and minimizes the resistance to rotation of the mixing bucket and integral mold 10. The spacing of the agitators 60 also ensures that the torque required to rotate the mixing bucket and integral mold 10 about the central axis 18 is relatively constant during mixing. It is very desirable to have a constant torque requirement when manually rotating a mixing bucket on the ground or other surface. Mixing containers with large continuous paddles require large torques during the portion of the rotation which causes the paddles to lift the material being mixed. If rotating force on the outside of the bucket is released while a continuous paddle is lifting material the mixing container may reverse directions.

The agitators 60 have a base 66 and an integral post 68. The base 66 has a conical surface 70 which is in contact with a portion of the inside surface of the walls 12. Surface 70 is conical so that it makes maximum contact with the inside surface of the walls 12. The taper of the walls 12 is relatively small so that an agitator 60 can be mounted at any place on the walls between the bottom wall 14 and the lid 16. The agitators 60 and the walls 12 are preferably made from a plastic material which can be joined by adhesives, by ultrasonic welding or possible some other joining procedure.

The mixing bucket and integral mold 12 can be used to mix a variety of materials. Some of the materials include water, aggregate with sizable stones and cement, to be used for footings or some other comparable use. Mortar for laying bricks or stones requires sand with small particle size, water and cement. Plaster and grout require water, a very fine sand and a binder such as cement. The different materials have different mixing requirements. A variety of agitators 60 have been developed to meet the different mixing requirements for the different materials.

Figure 4:
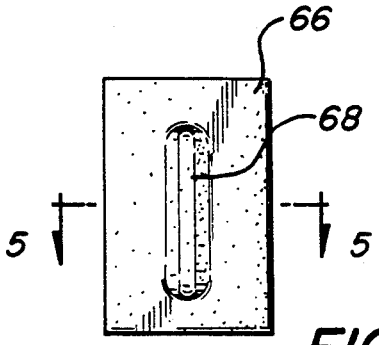
FIG. 4 is a radial view of a straight agitator looking toward the bucket wall.
Figure 5:
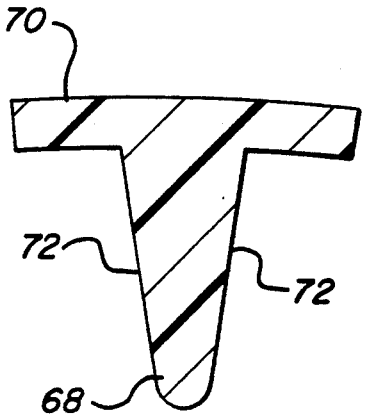
FIG. 5 is a sectional view of an agitator taken along line 5—5 in FIG. 4.

The agitator 60, as shown in FIGS. 1, 4 and 5, have a base 66 and an integral post 68. Post 68 extends radially from the base 66 toward the central axis 18. Post 68 has two agitation surfaces 72 which are in substantially flat planes that are parallel to the central axis 18. During rotation of the mixing bucket and integral mold 10 the surfaces 72 on post 68 move perpendicular to the material being mixed and displace material axially toward the bottom wall 14 and toward the lid 16. These posts 68 do not cause significant axial shifting of materials being mixed.

Figure 6:
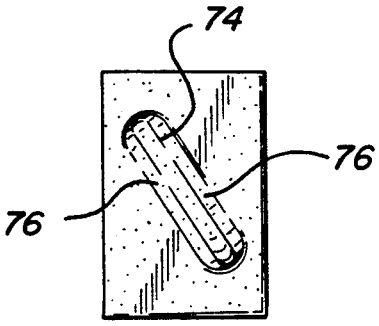
FIG. 6 is a radial view of an angled agitator looking toward the bucket wall.
Figure 7:
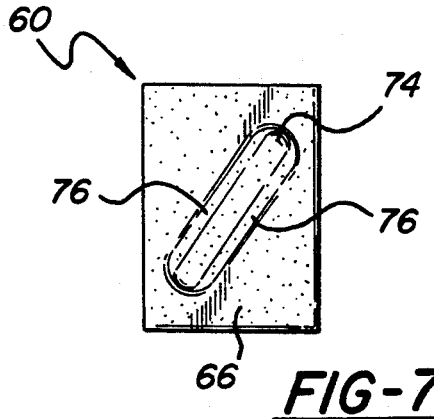
FIG. 7 is a radial view similar to FIG. 6 with the agitator post angled in the opposite direction.

The agitators 60, as shown in FIGS. 6 and 7, have posts 74 similar to the post 68 with surfaces 76 in flat planes that are at an angle to the central axis and that tend to shift material being mixed axially toward the bottom wall 14 or toward the lid 16. The post 74 will move material being mixed axially toward the bottom wall 14 in response to rotation of the mixing bucket and integral mold 10 in one direction about the central axis 18 and will move material being mixed axially toward the lid 16 in response to rotation of the mixing bucket and integral mold in the other direction about the central axis. The agitator 60 with a post 74 as shown in FIG. 7 will displace material being mixed in the opposite axial direction from the agitator as shown in FIG. 6. By using the agitators 60 as shown in FIG. 6 in the upper half of the mixing bucket and integral mold 10 adjacent to the lid 16 and using the agitators shown in FIG. 7 in the lower half of the mixing bucket and integral mold adjacent to the bottom wall 14 of the mixing bucket and integral mold, materials being mixed will be axially moved away from the lid 16 and the bottom of the wall 14 and toward the center of the mixing bucket in response to rotation in one direction. Rotation of the mixing bucket and integral mold 10 in the other direction will move material being mixed axially out of the center and toward the lid 16 and toward the bottom wall 14. Other arrangements of the agitators 60 in FIGS. 6 and 7 will either merely move material being mixed axially in one direction and then axially in the other direction or move material into bands axially spaced along the central axis 18.

Figure 8:
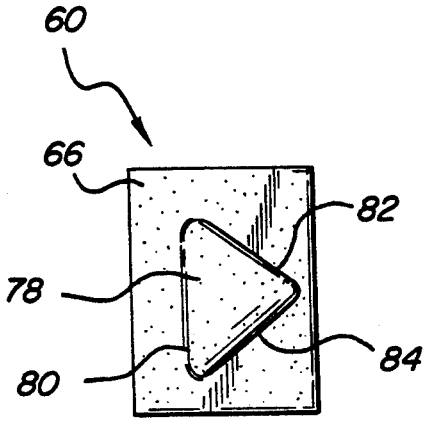
FIG. 8 is a radial view of an agitator having an agitator post with a triangular cross-section.

The agitator 60 as shown in FIG. 8 has a post 78 that is integral with a base 66. The post 78 has triangular cross-section. When rotated so that the flat surface 80 moves toward the material being mixed, it will act the same way as the post 68 as shown in FIGS. 1, 4 and 5. Rotation of the post 78 in the opposite direction so that the angled surfaces 82 and 84 divide the material being mixed will result in less aggressive agitation of the material being mixed. The angled surfaces 82 and 84 can also reduce the force required to rotate the mixing bucket and integral mold 10.

Figure 9:
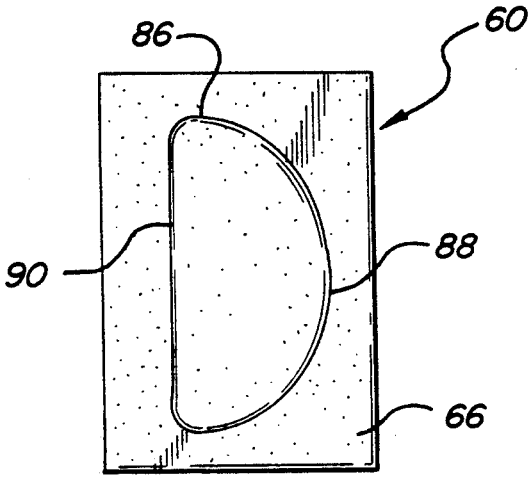
FIG. 9 is a radial view of a Convex agitator looking toward the bucket wall.

The post 86 of the agitator 60 shown in FIG. 9 has a convex surface 88 which divides material being mixed about like the angular surfaces 82 and 84 on the post 78 shown in FIG. 8. The convex surface 88 provides a little less aggressive mixing action than the flat surface 90 on the other side of the post 86.

Figure 10:
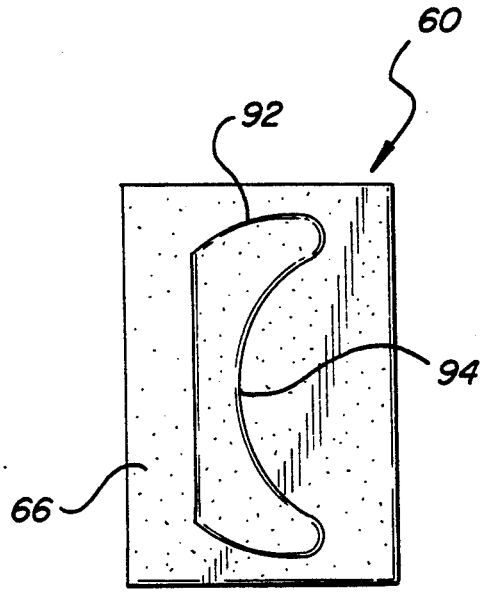
FIG. 10 is a radial view of a concave agitator looking toward the bucket wall.

The post 92 of the agitator 60 shown in FIG. 10 has a concave surface 94. The concave surface 94 tends to move material being mixed radially along the groove formed by the concave surface. Radial movement of the material will improve mixing of some materials.

Figure 11:
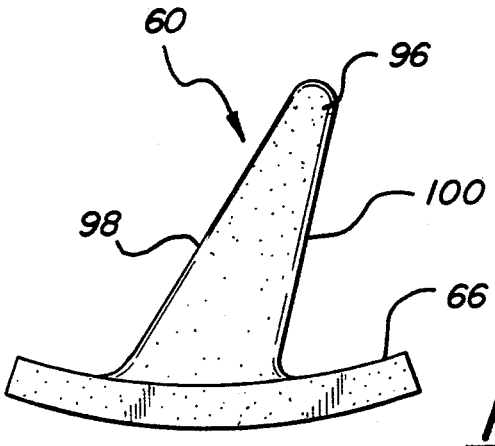
FIG. 11 is an axial view of an agitator having an agitator post with a free end that is angled toward the direction of rotation.

The post 96 of the agitator 60 shown in FIG. 11 is like the post 68 shown in FIG. 4 except the surfaces 98 and 100 are at a substantial angle to a plane through the base 66 that also contains the central axis 18. Movement of the surface 98 on the post 96 into material being mixed will tend to move the material radially away from the wall 12. Movement of the surface 100 on the post 96 into material being mixed will tend to move material radially toward the walls 12.

The frustoconical outside surface of the walls 12 of the mixing bucket and integral mold 10 direct the mixing bucket and integral mold in a large diameter circular path as it rolls along the ground. The diameter of the circular path depends upon the taper of the walls 12. If the mixing bucket and integral mold 10 has the same outside diameter at the top and bottom with the lid in the closed position, it will tend to roll in a straight line rather than in a circle.

The preferred embodiments of the invention have been described in detail but are examples only and the invention is not restricted thereto. It will be easily understood by those skilled in the art that modifications and variations can easily be made within the scope of the invention.

I claim:

1. A mixing bucket for mixing an aggregate, a binder and a liquid including a frustoconical wall with a central axis an inside surface and an outside surface; a bottom wall integral with the frustoconical wall; an open top; a top rim integral with a top edge of the frustoconical wall; a removable lid closing the open top and sealing between the lid and the frustoconical wall to prevent leakage of material from the bucket; a plurality of spaced apart agitators each having a base attached directly to the inside surface of the frustoconical wall along one or more helixes each of which extends at least ninety degrees around the central axis, an integral post that projects radially from the base toward the central axis and at least one agitation surface; and wherein the plurality of the spaced apart agitators includes at least one bottom agitator adjacent to the bottom wall, at least one top agitator adjacent to the lid when the lid is closed and a plurality of intermediate agitators along each helix axially spaced apart between the at least one bottom agitator and the at least one top agitator, the agitation surface on the integral posts agitate and mix the aggregate, binder and liquid inside the mixing bucket when the mixing bucket is rolled on its frustoconical wall and the spaced apart agitators along each helix are angularly spaced from each other around the central axis so that the agitators move into ad out of contact with the aggregate, binder and liquid being mixed, at least one agitator is in contact with the aggregate, binder and liquid being mixed at all times and the aggregate, binder and liquid being mixed exerts a substantially constant resistance to being rolled when the mixing bucket is less than full and is rolled on its frustoconical wall and wherein the axial width of each agitator is short and there is an annular zone provided between adjacent agitators along each helix where no agitators are present, and each annular zone has an axial width which defines the axial space between said adjacent agitators.

2. A mixing bucket as set forth in claim 1 in which the agitators are attached to the inside surface of the frustoconical walls along at least two helixes and there is a bottom agitator on each helix, a top agitator on each helix and a plurality of intermediate agitators axially spaced along each helix between the bottom agitator and the top agitator.

3. A mixing bucket as set forth in claim 2 in which the two helixes have the same pitch and are spaced 180 degrees from each other.

4. A mixing bucket as set forth in claim 1 wherein at least some of the agitators have a first planar agitation surface on the integral post which agitates and mixes the aggregate, binder and liquid when the bucket is rolled on its frustoconical wall in a first direction and a second planar agitation surface on the integral post which agitates and mixes the aggregate, binder and liquid when the bucket is rolled on its frustoconical wall in a second direction.

5. A mixing bucket as set forth in claim 4, wherein the first planar agitation surface on the integral post and the second planar agitation surface on the integral post are in planes that are parallel to the central axis.

6. A mixing bucket as set forth in claim 4 wherein the first and second planar agitation surfaces are in planes that are at an angle to the central axis and tend to move the aggregate, binder and liquid being agitated and mixed toward the bottom wall when the mixing bucket is rolled on its frustoconical wall in said first direction and to move the aggregate, binder and liquid being agitated and mixed toward the lid when the bucket is rolled on its frustoconical wall in said second direction.

7. A mixing bucket as set forth in claim 1 wherein the agitators have first and second planar agitation surfaces on the integral post that are in planes that are angled relative to the central axis and wherein the agitators are attached to the inside surfaces of the frustoconical wall so that the first planar agitation surfaces move the aggregate, binder and liquid being mixed axially toward the center of the bucket and away from the bottom wall and away from the lid when the bucket is rolled on its frustoconical wall in a first direction and so that the second planar agitation surfaces move the aggregate, binder and liquid being mixed axially toward the bottom wall and toward the lid when the bucket is rolled on its frustoconical wall in a second direction.

8. A mixing bucket as set forth in claim 1 wherein at least some of the agitators have a first agitation surface on their integral post that is convex and displaces the aggregate, binder and liquid being mixed axially toward the bottom wall and toward the lid when the bucket is rolled on its frustoconical wall in a first direction.

9. A mixing bucket as set forth in claim 1 wherein at least some of the agitators have a first agitation surface on their integral post that is concave and displaces the aggregate, binder and liquid being mixed radially and parallel to the axis of a radius of curvature of the agitation surface when the bucket is rolled on its frustoconical wall in a first direction.

10. A mixing bucket as set forth in claim 1 wherein at least some of the agitators have a first agitation surface on the integral post which extends inwardly toward the central axis from the base and toward the direction of rotation and moves the aggregate, binder and liquid being mixed outwardly toward the inside surface of the frustoconical wall of the bucket during rotation of the bucket on its frustoconical wall in a first direction.

11. A mixing bucket as set forth in claim 1 wherein at least some of the agitators have a first agitation surface on the integral post which extends inwardly toward the central axis and away from the direction of rotation and moves the aggregate, binder and liquid being mixed radially inward and away from the frustoconical wall of the bucket during rotation of the bucket on its frustoconical wall in a first direction.

12. A mixing bucket as set forth in claim 1 wherein the frustoconical wall extends past the bottom wall to form a bottom rim that holds the bottom wall up away from a bucket support surface and flanges integral with the bottom wall and within the bottom rim that form a mold for concrete and reinforce and support the bottom wall.

13. A mixing bucket as set forth in claim 12, wherein the flanges have bottom surfaces that are in the same plane as the bottom surface of the bottom rim.

14. A mixing bucket as set forth in claim 1 wherein the frustoconical wall extends axially past the bottom wall to form a bottom rim that holds the bottom wall up way from a bucket support surface and interconnecting flanges that form a mold for forming concrete into a desired shape, positioned in the area defined by the bottom rim and adjacent to the bottom wall to provide support for said bottom wall.

15. A mixing bucket including a frustoconical wall with an inside surface, an outside surface and a central axis; a bottom wall integral with the frustoconical wall; an open top, a top rim integral with a top edge of the frustoconical wall; a removable lid closing the open top and sealing between the lid and the frustoconical wall to prevent leakage of material from the bucket; a plurality of spaced agitators, each having a base attached to the inside surface of the frustoconical wall, an integral post that projects radially from the base toward the central axis and at least two agitation surfaces, and wherein the plurality of the spaced agitators includes at least one bottom agitator adjacent to the bottom wall, at least one top agitator adjacent to the lid when the lid is closed and a plurality of intermediate agitators axially spaced between the at least one bottom agitator and the at least one top agitator, the agitation surfaces on the integral posts agitate and mix the material inside the bucket when the bucket is rolled on its frustoconical wall, and wherein the at least two agitation surfaces include first and second planar agitation surfaces on each integral post that are in planes that are angled relative to the central axis and wherein the agitators are attached to the inside surface of the frustoconical walls so that the first planar agitation surfaces contain means for moving the material being mixed axially toward the center of the bucket and away from the bottom wall and away from the lid when the bucket is rolled on its frustoconical wall in a first direction and the second planar agitation surfaces contain means for moving the material being mixed axially away from the center of the bucket and toward the bottom wall and toward the lid when the bucket is rolled on its frustoconical wall in a second direction.

16. A mixing bucket including a frustoconical wall with an inside surface, an outside surface and a central axis; a bottom wall integral with the frustoconical wall; an open top; a top rim integral with a top edge of the frustoconical wall; a removable lid closing the open top and sealing between the lid and the top edge to prevent leakage of material from the bucket; a plurality of spaced agitators each having a base attached to the inside surface of the frustoconical wall, an integral post that projects radially from the base toward the central axis and at least one agitation surface on the post, and wherein the plurality of the spaced agitators includes at least one bottom agitator adjacent to the bottom wall, at least one top agitator adjacent to the lid when the lid is closed and a plurality of intermediate agitators axially spaced between the at least one bottom agitator and the at least one top agitator, the agitation surfaces on the integral posts agitate and mix the material inside the bucket when the bucket is rolled on its frustoconical wall, and wherein the at least one agitation surface on at least some of the agitators is a convex surface including means for displacing the material being mixed axially toward the bottom wall and toward the lid when the bucket is rolled on its side in a first direction.

* * * * *